US005721570A

United States Patent [19]

Tsunoda et al.

[11] Patent Number: 5,721,570

[45] Date of Patent: Feb. 24, 1998

[54] DISPLAY CONTROL APPARATUS

[75] Inventors: Takashi Tsunoda, Yokohama; Yuichi Takagi, Tokyo, both of Japan

[73] Assignee: Canon Kabushiki Kaisha, Tokyo, Japan

[21] Appl. No.: 857,904

[22] Filed: May 16, 1997

Related U.S. Application Data

[63] Continuation of Ser. No. 355,025, Dec. 19, 1994, abandoned.

[30] Foreign Application Priority Data

Dec. 28, 1993 [JP] Japan ..... 5-337378

[51] Int. Cl.[6] ..... G09G 5/00

[52] U.S. Cl. ..... 345/213; 348/536; 331/1 R

[58] Field of Search ..... 345/211, 212, 345/213, 202, 204; 348/536, 540, 544, 545, 546, 547, 148, 158; 331/20, 1 A, 1 R

[56] References Cited

U.S. PATENT DOCUMENTS

| | | | |
|---|---|---|---|
| 4,795,239 | 1/1989 | Yamashita et al. | 350/333 |
| 4,809,068 | 2/1989 | Nagai | 331/20 |
| 4,812,783 | 3/1989 | Honji et al. | 348/546 |
| 4,827,341 | 5/1989 | Akimoto et al. | 258/148 |
| 4,843,471 | 6/1989 | Yazawa et al. | 358/160 |
| 5,068,731 | 11/1991 | Takeuchi . | |
| 5,124,671 | 6/1992 | Srivastava | 331/10 |
| 5,184,350 | 2/1993 | Dara | 370/105.3 |
| 5,185,603 | 2/1993 | Medin | 340/814 |
| 5,202,906 | 4/1993 | Saito | 331/1 A |
| 5,353,041 | 10/1994 | Miyamoto et al. | 345/97 |
| 5,479,073 | 12/1995 | Mamiya et al. | 315/169.3 |

FOREIGN PATENT DOCUMENTS

| | | | |
|---|---|---|---|
| 0544245 | 11/1991 | European Pat. Off. | H04N 1/00 |
| 0622775 | 4/1994 | European Pat. Off. | G09G 5/18 |
| 62-256521 | 11/1987 | Japan . | |
| 3009615 | 1/1991 | Japan . | |

*Primary Examiner*—Regina Liang

*Attorney, Agent, or Firm*—Fitzpatrick, Cella, Harper & Scinto

[57] ABSTRACT

A horizontal synchronizing signal is applied as a reference signal and a voltage-controlled oscillator outputs a frequency signal on the basis of the frequency of the horizontal synchronizing signal. The period of the frequency signal is divided in accordance with a frequency-dividing value set in advance, the difference in frequency between the frequency-divided frequency signal and the horizontal synchronizing signal and the phase difference between them are obtained, and control is performed in such a manner that the frequency of the signal outputted by the voltage-controlled oscillator is decided in dependence upon the frequency difference. In an interval in which a vertical synchronizing signal turns off and the frequency of the horizontal synchronizing signal fluctuates, the input to the voltage-controlled oscillator is held fixed to prevent a fluctuation in the outputted display clock.

12 Claims, 7 Drawing Sheets

DISPLAY CONTROL APPARATUS

This application is a continuation of application Ser. No. 08/355,025 filed Dec. 13, 1994, now abandoned.

BACKGROUND OF THE INVENTION

This invention relates to a display control apparatus and, more particularly, to a display control apparatus for presenting a display by generating a signal having a multiplied frequency on the basis of the frequency of a reference signal.

A well-known example of a circuit which, on the basis of the frequency of a given reference signal, generates an output signal whose frequency is a multiple of the reference frequency is an oscillator circuit referred to as a PLL (phase-locked loop) which compares the reference signal and the output signal in terms of both frequency and phase and performs control in such a manner that the input signal and a frequency signal outputted by a VCO (voltage-controlled oscillator) maintain a phase difference that is proportional to the difference between the free oscillation frequency of the VCO and the frequency of the input signal. In a PLL circuit of this kind, the output signal from the VCO is frequency-divided by a prescribed dividing value (a preset value), after which the frequency and phase of the resulting signal are compared with the frequency and phase of the reference signal. For example, in a display apparatus, a horizontal synchronizing signal is adopted as the reference signal and a PLL circuit of the above-mentioned type is used to multiply the frequency of the reference signal and generate the synchronizing clock of a video signal.

However, there are display apparatus in which the horizontal synchronizing signal serving as the reference signal is outputted at a frequency different from that at the time of the display operation in intervals where a vertical synchronizing signal is off, by way of example. In case of such an apparatus, the fact that the conventional PLL circuit can be preset to only one dividing value means that the PLL circuit will not operate normally during the time that the vertical synchronizing signal is off. The result is an increase in jitter or failure of the PLL circuit to lock the output signal.

SUMMARY OF THE INVENTION

Accordingly, an object of the present invention is to provide a display control apparatus in which, even if a reference signal is outputted at a plurality of frequencies, is capable of generating a display clock signal that is stable with respect to changes in frequency.

Another object of the present invention is to provide a display control apparatus in which, when a display clock signal is generated using a horizontal synchronizing signal as a reference signal, is capable of preventing disturbance of the display even if the frequency of the horizontal synchronizing signal fluctuates in a blank interval.

A further object of the present invention is to provide a display control apparatus in which operation of a PLL circuit used in a display control circuit is assured.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

Preferred embodiments of the present invention will now be described in detail with reference to the accompanying drawings.

Figure 1:
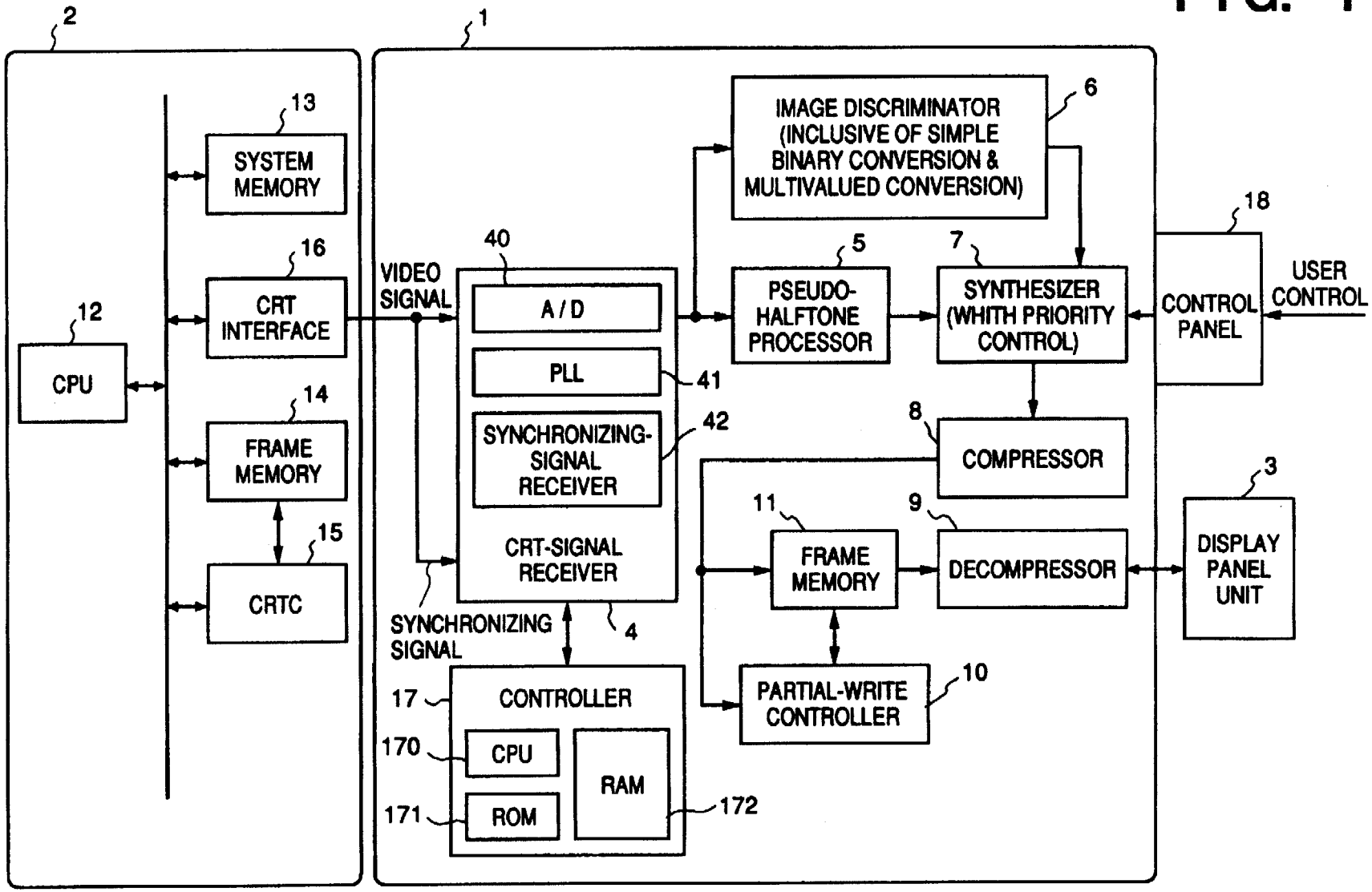
FIG. 1 is a block diagram illustrating an information processing system having a display control apparatus according to an embodiment of the present invention.

FIG. 1 is a block diagram illustrating an information processing system having a display control apparatus according to an embodiment of the present invention.

The system of FIG. 1 includes a display control apparatus 1 according to this embodiment, a computer 2 such as a personal computer or work station serving as an information source for supplying the display control apparatus 1 with information, and a display panel unit 3 for displaying image information under the control of the display control apparatus 1. Though not illustrated, the display control panel 3 includes a drive circuit for driving a display panel, a control circuit for controlling drive under conditions ideal for the display panel, a panel back-light and a power supply. The display control apparatus 1 has a CRT-signal receiver 4 which receives CRT display signals (image signal and synchronizing signals) outputted by the computer 2, converts these signals to signals suited to the components of the next stage and then outputs the signals.

Since CRT signals from an ordinary computer are analog video signals, the CRT-signal receiver 4 is internally provided with an A/D converter 40, a PLL circuit 41 which generates a sampling clock for the A/D conversion, and a synchronizing-signal receiver 42. Image information converted to a digital signal by the A/D converter 40 of the CRT-signal receiver 4 is applied to a pseudo-halftone processor 5, which executes pseudo-halftone processing for subjecting the image information to a binary or multivalued conversion. Methods of binary and multivalued pseudo-halftone processing are as follows:

<Error-dispersion method>

According to this method, weighting is applied to a binary or multivalued error produced when peripheral pixels of a pixel of interest (where the peripheral pixels are pixels which prevail before the pixel of interest is processed) are binarized or converted to multiple values, after which the resulting weighted value is added to the pixel of interest and binarization is performed using a fixed threshold value.

<Mean-density preservation method>

According to this method, the binarization threshold value is not fixed. Rather, the threshold value is decided by a weighted mean obtained from already binarized data neighboring the pixel of interest, and the threshold value is capable of being varied depending upon the state of the pixels.

Pseudo-halftone processing can be executed using at least one of these methods. It is also possible to provide means for executing more than one of these methods and changeover between the means as by allowing the user to make the selection.

The image information outputted by the CRT-signal receiver 4 is sent to an image discriminator 6, which is capable of executing simple binarization processing or multivalued-conversion processing. The image discriminator 6 separates portions of the image from the input image information that should not be subjected to binarizing halftone processing. These portions include characters, fine lines, etc. The image discriminator 6 includes a processor for executing simple binarization processing in cases where binarizing halftone processing is not performed. An example of a method of image discrimination carried out by the image discriminator 6 is as follows:

<Luminance discriminating method>

One method of separating a luminance signal is to separate an image based upon the magnitude of the luminance value of the CRT image signal. In general, characters and fine lines displayed by a computer represent important image information and therefore the luminance thereof is comparatively high. Accordingly, portions of high luminance are identified in the CRT image signal and the luminance signals of these portions are separated.

A synthesizer (with a switching-priority function) 7 superimposes the data obtained by the pseudo-halftone processor 5 and simple binarized data obtained by the image discriminator 6. Image information of portions determined to be characters or fine lines by the image discriminator 6 are subjected to simple binarization at a higher priority. Implementation of this priority function can be changed over by the user.

When the binary data that has been subjected to binarizing pseudo-halftone processing by the synthesizer 7 is stored in a frame memory 11, a compressor 8 compresses the binary data to reduce the volume of data so that the capacity of the frame memory 11 can be kept small. A decompressor 9 decompresses one frame of binary data stored in the frame memory 11. A partial-write controller 10 detects a portion which has undergone a change in a frame of image data displayed on the display panel unit 3 and outputs the data of the changed portion to the display panel unit 3 at a higher priority. This function makes it possible to give higher priority to the display of portions of image data that have changed. The frame memory 11 stores the image data displayed on the display panel unit 3. A controller 17 controls the operation of each component constructing the display control apparatus 1. The connections to these components is not illustrated. The controller 17 includes a CPU 170, a ROM 171 storing the control program of the CPU 170 as well as various data, and a RAM 172 used as the work area of the CPU 170. A control panel 18, which includes various keyboards and pointing devices, enters control data and commands on the basis of operations performed by the user.

The construction of the computer 2 will now be described.

The computer 2 includes a CPU 12 which controls the computer, and a system memory 13 which stores the control program of the CPU 12 as well as various data. The system memory 13 is also used as the work area of the CPU 12 and saves a variety of data temporarily. The computer 2 also has a frame memory 14 which stores image data processed by the computer 2, a CRT controller (CRTC) 15 for controlling transmission of the image information stored in the frame memory 14 to the display control apparatus 1, and a CRT interface 16 for converting image information stored in the frame memory 14 to CRT signals. The conversion includes conversion of analog signals, color conversion, etc.

Operation of the components shown in FIG. 1 will now be described on the basis the arrangement set forth above.

First, the computer 2, which is a source of image information, outputs the image information that has been stored in the frame memory 14 as the CRT signals via the CRT interface 16 under the control of the CRTC 15. The CRT signals are divided up into a video signal (e.g., three analog signals R, G, B in case of a color signal; one analog signal in case of a monochromatic display) and synchronizing signals (signals, inclusive of horizontal and vertical synchronizing signals, for partitioning the video signal line by line or frame by frame).

The CRT signals enter the CRT-signal receiver 4 of the display control apparatus 1. The video signal is converted to a digital signal (comprising a plurality of bits) by the A/D converter 40. The sampling clock at the time of the A/D conversion is produced by the PLL circuit 41, which frequency-multiplies the horizontal synchronizing signal sent from the computer 2. The resulting digital signal enters the pseudo-halftone processor 5, where by the video signal is converted to binary or multivalued data. In order to convert the CRT signal from the computer 2 whenever required in the conversion procedure executed at this time, the conversion is performed in non-interlaced fashion. Distribution of error for pseudo-halftone processing and calculation of the threshold value can be carried out according to theory. As a result, the reproducibility of the image data that has been subjected to halftone processing is improved.

The digital signal (image information) from the CRT-signal receiver 4 simultaneously enters the image discriminator 6, where portions of the signal not suited to pseudo-halftone processing, such as the aforesaid characters and fine lines, are identified, and only these portions are subjected to simple binarization or simple multivalued conversion and then outputted. The binary or multivalued signal obtained by the pseudo-halftone processor 5 and image discriminator 6 is switched to in the synthesizer 7 and the result is delivered from the synthesizer 7 to the compressor 8. The changeover in the synthesizer 7 is carried out in such a manner that the simple binary signal or simple multivalued signal obtained by the image discriminator 6 is outputted preferentially. The changeover priority function in synthesizer 7 may be implemented by the display control apparatus 1 itself on the basis of a command or the like entered by the operator using the control panel 18 or forcibly in response to an instruction from the computer 2. This priority processing is particularly useful in a case where it is desired to display characters or fine lines preferentially or in a case where it is desired to display a natural picture such as a photograph preferentially.

The compressor 8 compresses the signal from the synthesizer 7 and outputs the compressed signal to the frame memory 11. Since partial-write control by the partial-write controller 10 is control in line units, a desirable compression method is one which performs compression in line units. The signal thus compressed by the compressor 8 is sent to the partial-write controller 10 at the same time. Here a compressed signal of at least the preceding frame is read out of the frame memory 11 and the read signal is compared with the signal just sent from the compressor 8. The partial-write controller 10 detects the line of a pixel for which a difference between the preceding image signal and the present image signal has been detected and performs control in such a manner that this line signal and line information (line-image compressed signal) are preferentially outputted to the decompressor 9 from the frame memory 11. The compressed image signal thus sent to the decompressor 9 is demodulated (decompressed) by the decompressor 9 and then outputted to the display panel unit 3. The latter accepts the line-unit image signal from the display control apparatus 1 and displays image information in dependence upon the line image information and line signal.

When all of the input video signals are subjected to pseudo-halftone processing for the sake of a binary or multivalued conversion in a case where the painting speed of display panel unit 3 is lower than the input transfer speed of the video signal that enters from the display control apparatus 1, none of the signals converted to binary or multivalued signals can be displayed. Since this means that the pseudo-halftone processor 5 will be executing needless processing, the input video signals are entered upon being thinned out in frame units in dependence upon the painting speed of the display panel unit 3.

As a result, the time during which pseudo-halftone processing is performed for the sake of the binary or multivalued conversion may be increased by an amount of time equivalent to the frames thinned out, and therefore the processing speed of pseudo-halftone processing may be lowered. Accordingly, even if it is desired to fabricate the pseudo-halftone processor 5 as an IC, there is no need for the operating speed thereof to be very high. This makes it possible to prevent the generation of heat and the occurrence of erroneous operation caused by circuitry capable of high-speed operation.

The construction of the PLL circuit 41 of CRT-signal receiver 4 will now be described with reference to FIG. 2.

Figure 2:
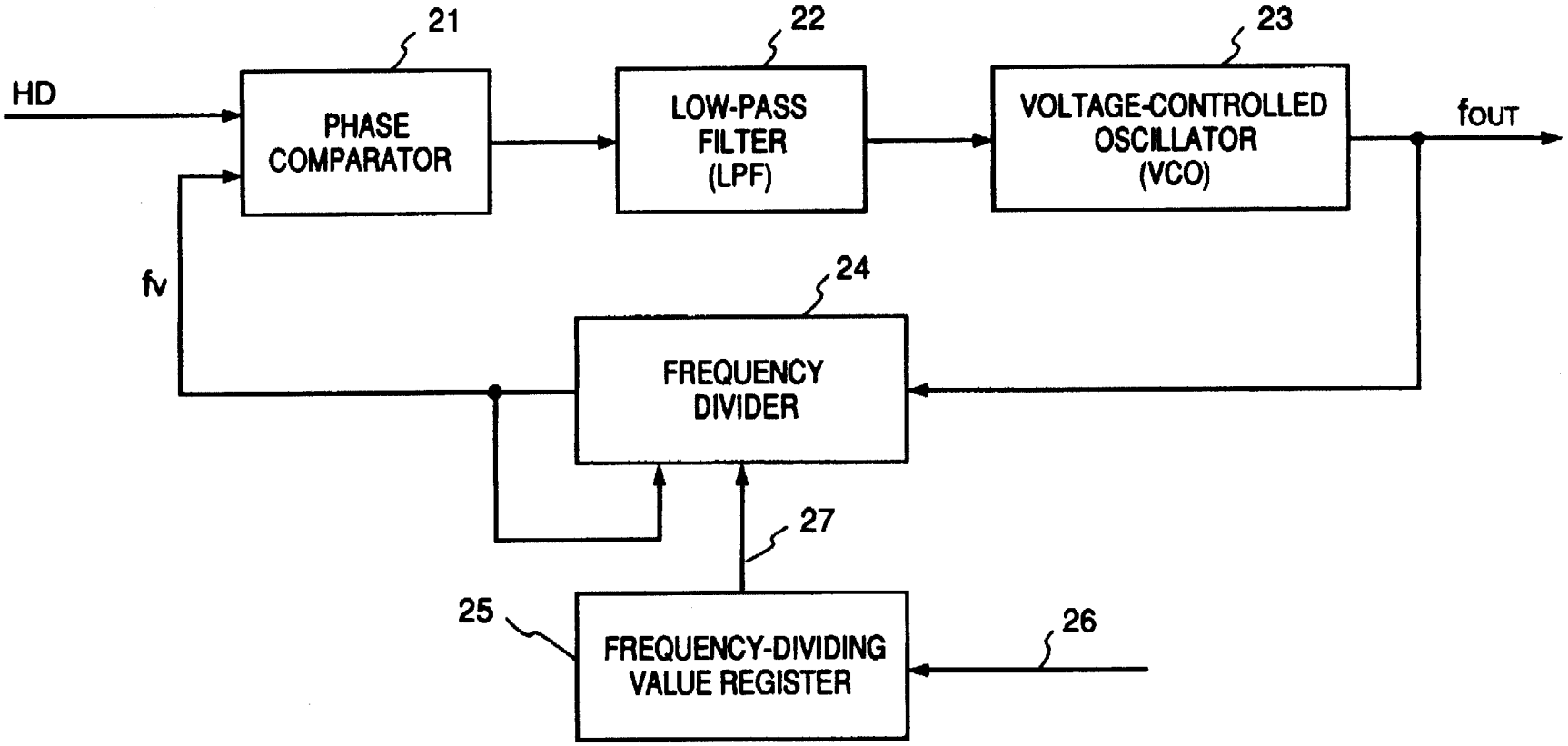
FIG. 2 is a block diagram illustrating the construction of a PLL circuit of a CRT-signal receiver according to a first embodiment of the present invention.

FIG. 2 is a block diagram illustrating the construction of the PLL circuit 41 contained in the CRT-signal receiver 4 of this embodiment.

A horizontal synchronizing signal HD which enters from the computer 2 is fed into a phase comparator 21. A signal fv enters the other input terminal of the phase comparator 21. The phase comparator 21 senses the frequencies of these two input signals (HD, fv) as well as the phase difference between them, generates an average DC voltage proportional to the error (difference) between the signals and delivers the DC voltage to a low-pass filter (LPF) 22. The error signal is applied to the control terminal of a voltage-controlled oscillator (VCO) 23 through the low-pass filter. The frequency of the output signal of the VCO 23 is varied in a direction which reduces the oscillation frequencies of the reference signal (HD) and VCO 23 as well as the phase difference between them. The voltage-controlled oscillator (VCO) 23 generates a signal $f_{OUT}$ (a pixel synchronizing signal or dot clock signal) on the basis of the DC voltage entering from the low-pass filter 22. The signal $f_{OUT}$ produced by the voltage-controlled oscillator 23 is frequency-divided by a frequency divider 24 on the basis of a value in a dividing-value register 25, and the resulting signal is fed back to the phase comparator 21 as the signal fv. By adopting this arrangement, the desired frequency signal $f_{OUT}$ (which has been frequency-multiplied in conformity with the value in the register 25) can be obtained from the voltage-controlled oscillator 23 on the basis of the reference signal (horizontal synchronizing signal HD).

It should be noted that the dividing value in the register 25 is set at the start. The setting method is to write in the value by the CPU 170 of the controller 17 via a signal line 26. The dividing value that has been written in the register 25 is controlled on the basis of fv. When the signal fv becomes logical "0", the dividing value in the register 25 is written in the divider 24 again via a signal line 27. The frequency divider 24 frequency-divides the output signal $f_{OUT}$ (which corresponds to a multiple of the horizontal synchronizing signal HD) of the voltage-controlled oscillator 23 by the prescribed dividing value and outputs fv as the result. Thereafter, the phase comparator 21 compares the frequencies of the reference signal (horizontal synchronizing signal HD) and phase signal fv and applies phase locking. As a result, in a case where the value in the dividing-value register 25 is N, the frequency of the output signal $f_{OUT}$ from the voltage-controlled oscillator 23 is locked at a frequency which is N times the frequency of the reference signal (horizontal synchronizing signal HD).

[Second Embodiment]

Figure 3:
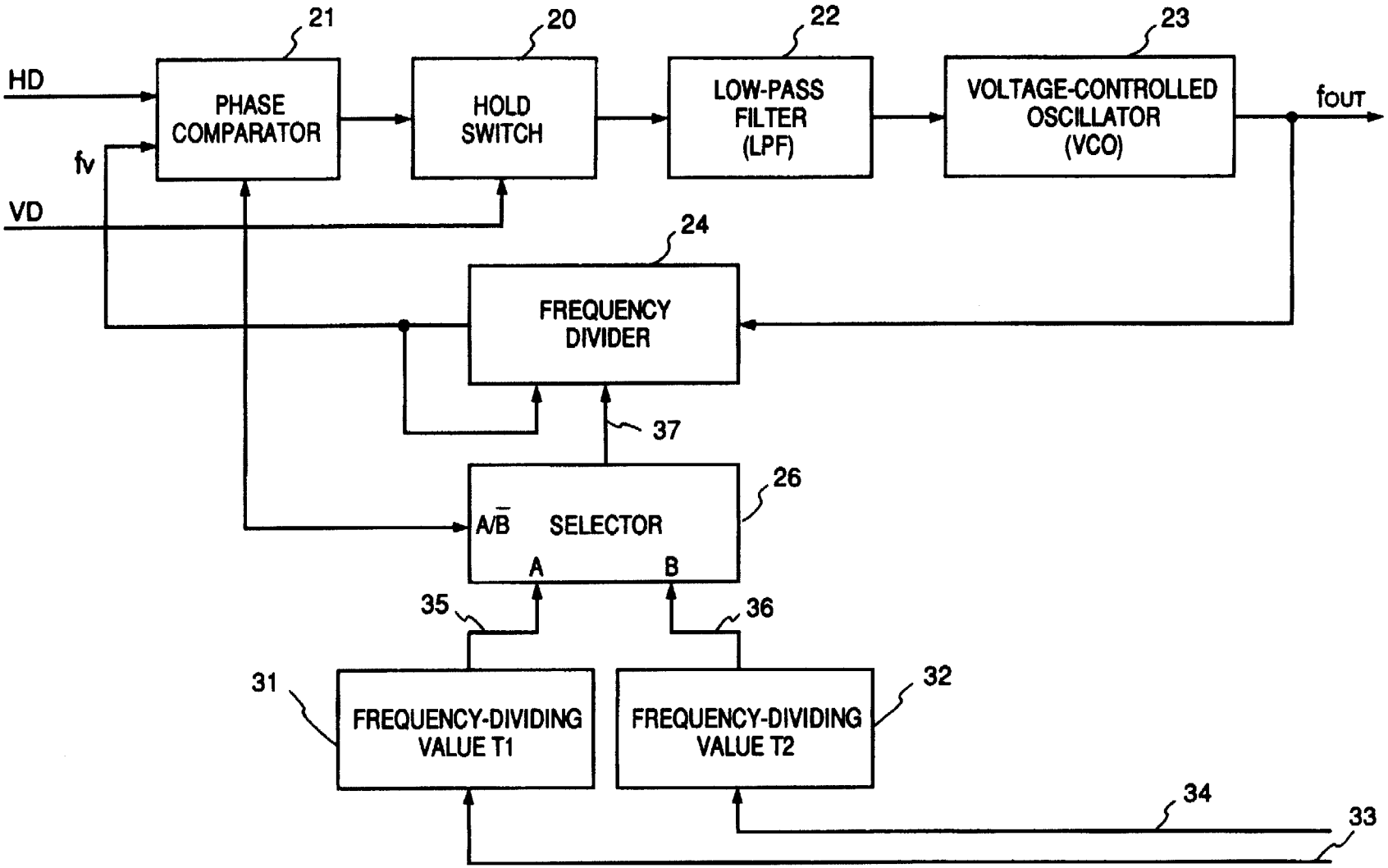
FIG. 3 is a block diagram illustrating the construction of a PLL circuit of a CRT-signal receiver according to a second embodiment of the present invention.

FIG. 3 is a block diagram illustrating the construction of the PLL circuit 41 according to a second embodiment of the present invention. In a case where the horizontal synchronizing signal HD is outputted during the time that a vertical synchronizing signal VD is at a low level (i.e., in blank intervals) and, moreover, the period of the horizontal synchronizing signal is short, the frequency-dividing ratio is changed over in dependence upon the level of the vertical synchronizing signal VD to deal with a change in the frequency of the horizontal synchronizing signal HD in order to prevent a phase shift in the phase comparator 21.

In FIG. 3, the controller 17 sets frequency-dividing values T1, T2 in frequency-dividing value registers 31, 32 via signal lines 33, 34, respectively, when power is introduced from the power supply. Output signal lines 35, 36 of these registers 31, 32 are connected to a selector 26. The selector 26 selects the signal on the signal line 35 or 36 in dependence upon a control signal (vertical synchronizing signal VD) and delivers the signal to the frequency divider 24 via the signal line 37. For example, when the control signal (vertical synchronizing signal VD) is logical "1", the frequency-dividing value T1 in the register 31 is delivered to the signal line 37 via the signal line 35 and selector 26, whereby the T1 is set in the frequency divider 24. When the control signal (vertical synchronizing signal VD) is logical "0" (the blank interval), the frequency-value T2 (T2>T1) in register 32 is selected and set in the frequency divider 24 via the signal line 37.

The operation of the PLL circuit 41 shown in FIG. 3 is basically the same as that of the circuit shown in FIG. 2 described above. With the PLL circuit of FIG. 3, however, the two frequency-dividing values (T1, T2) are stored in advance and the two values are switched between in dependence upon the level of the control signal (vertical synchronizing signal VD). At the same time, a hold switch 20 is turned off (opened) only in an interval in which the vertical synchronizing signal VD is at logical "0" (the blank interval), as a result of which the output signal of the phase comparator 21 is not sent to the low-pass filter 22, which is the next stage. In the blank interval, therefore, the level of the signal sent from the low-pass filter 22 to the voltage-controlled oscillator (VCO) 23 is held at the signal level which prevailed just before the opening of the hold switch 20. (This is the holding state.) In other words, even in the holding state, the clock signal $f_{OUT}$ supplied to the system does not fluctuate since the input to the control terminal of the voltage-controlled oscillator 3 is constant. The clock signal $f_{OUT}$ may thus be supplied stably.

Figure 4:
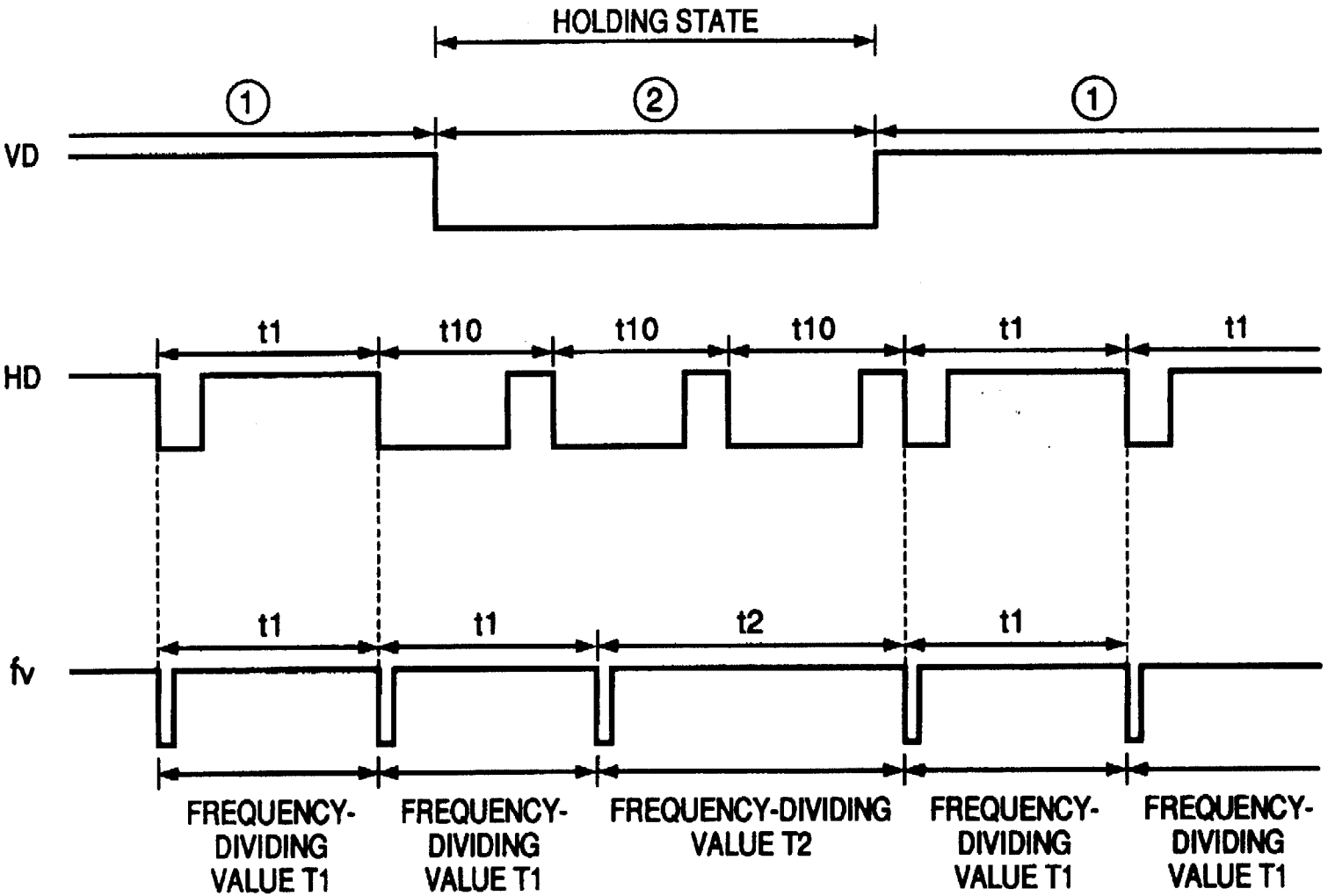
FIG. 4 is a timing chart showing the operation of the circuit of FIG. 3.

FIG. 4 is a timing chart illustrating the operation timing of the circuit shown in FIG. 3. The timing chart shows the timing for switching between the frequency-dividing values T1, T2.

The PLL circuit 41 operates at a period t1 when the signal level of the control signal (vertical synchronizing signal VD) is logical "1" (which corresponds to interval ① in FIG. 4), and at a period t2 when the signal level of the control signal (vertical synchronizing signal VD) is logical "0" (which corresponds to interval ② in FIG. 4). The timing at which the frequency-dividing value T1 or T2 is loaded in the frequency divider 24 from the frequency-dividing register 31 or 32 is that at which the signal level of the signal fv is logical "0". Here the horizontal synchronizing signal HD is outputted at the period t1 when the vertical synchronizing signal VD is at the high level (logical "1") and at a period t10 (t10<t1) when the vertical synchronizing signal VD is at the low level (logical "0").

If the signal level of the control signal (vertical synchronizing signal VD) is logical "1", then the hold switch 20 sends the output signal of the phase comparator 21 to the low-pass filter 22 as is. At the same time, the frequency divider 24 outputs the signal fv, whose frequency is a multiple of that of the signal $f_{OUT}$ in accordance with the frequency-dividing value T1, since the value T1 in the frequency-dividing value register 31 has been selected by the selector 26. When the signal fv becomes logical "1" in this interval, the frequency-dividing value T1 (period t1) selected by the selector 26 is loaded in the frequency divider 24 again.

By contrast, if the signal level of the control signal (vertical synchronizing signal VD) is logical "0", then the hold switch 20 is turned off so that the output signal of the phase comparator 21 is not sent to the low-pass filter 22. Instead, the value being held in the switch 20 is outputted. As a result, the output of the low-pass filter 22 assumes the holding state. Thus, the signal level which prevailed prior to turn-off of the hold switch 20 is kept applied to the voltage-controlled oscillator 23. The frequency of the signal $f_{OUT}$ does not change and the signal $f_{OUT}$ of stabilized frequency continues to be outputted. At this time the selector 26 selects the frequency-dividing value T2 (period t2) of the register 32 and delivers the value T2 to the frequency divider 24. Thus, the frequency-dividing values T1, T2 are set in conformity with the signal level of the control signal (vertical synchronizing signal VD) and the PLL circuit 41 operates in dependence upon this frequency-dividing value.

The reason for changing over the frequency-dividing value of the frequency divider 24 from T1 to T2 when the vertical synchronizing signal VD is in the off interval (interval ②) is to arrange it so that the output of the phase comparator 21 in interval ② will not fluctuate greatly with regard to interval ① by changing the frequency of the signal fv in conformity with the frequency t10 of the horizontal synchronizing signal HD in the interval ②. As a result, the output of the phase comparator 21 does not fluctuate even when the interval returns to the interval ①. This means that the frequency of the clock signal $f_{OUT}$ will not be disturbed.

[Third Embodiment]

Figure 5:
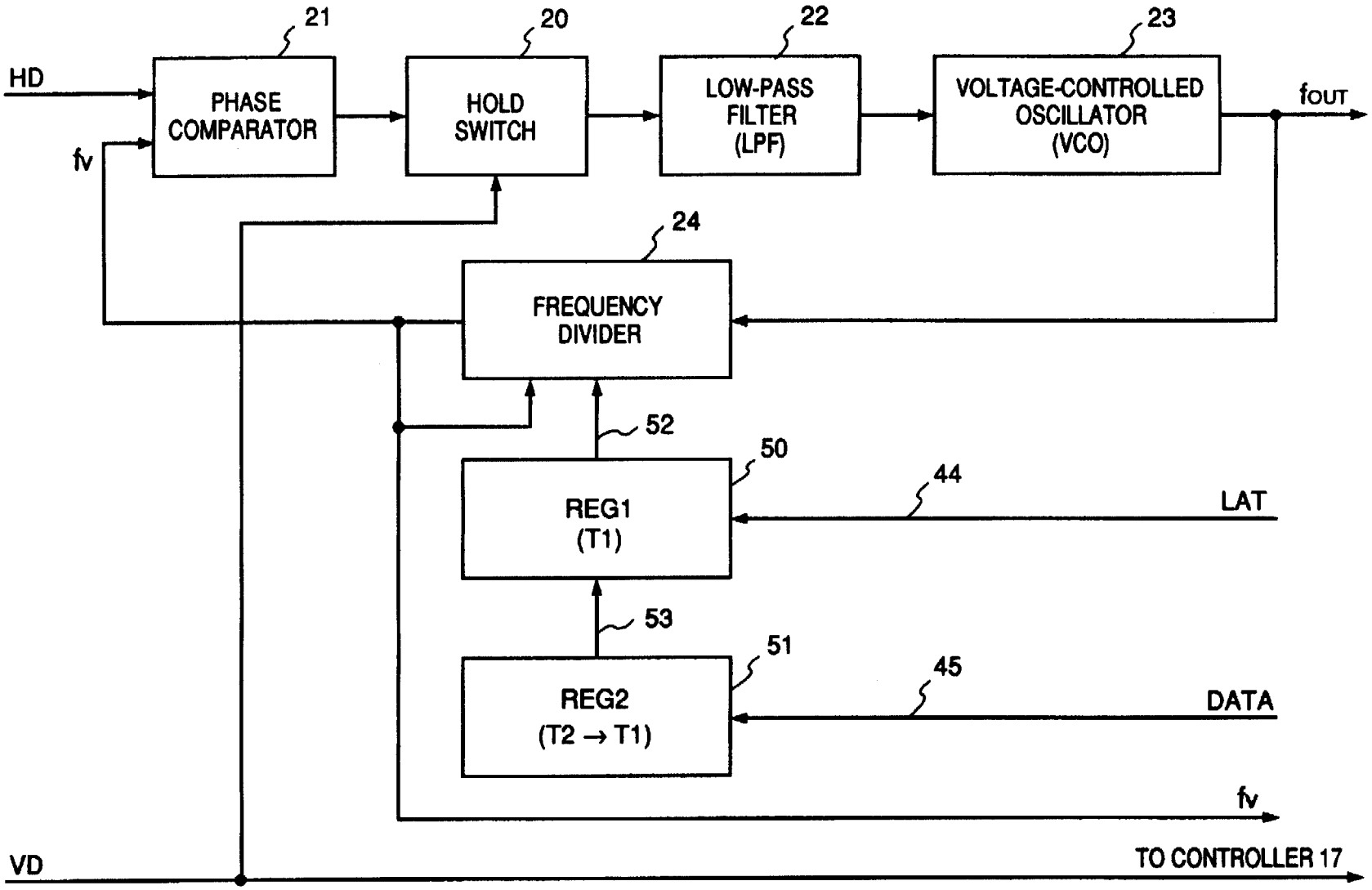
FIG. 5 is a block diagram illustrating the construction of a PLL circuit according to a third embodiment of the present invention.
Figure 6:
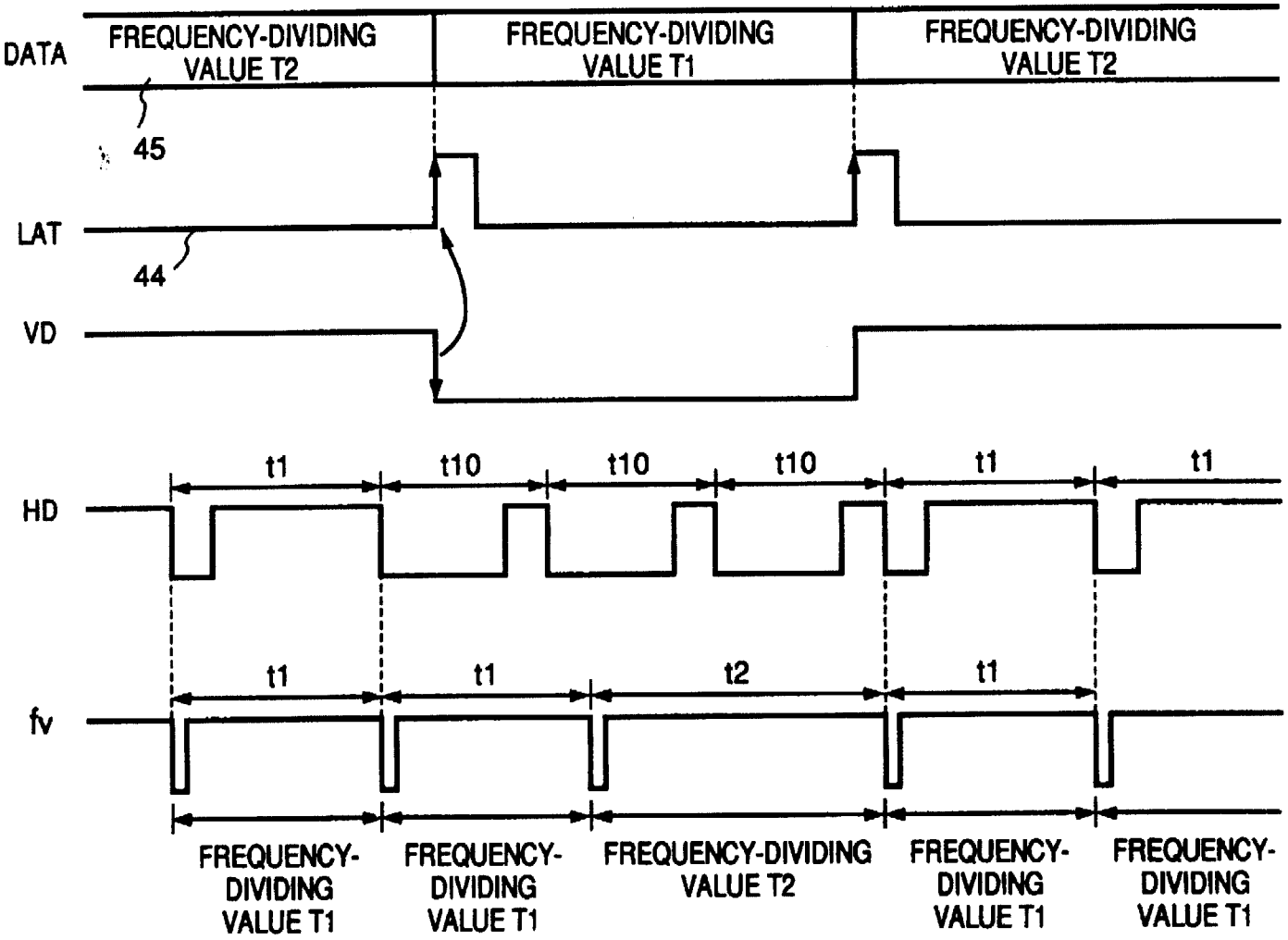
FIG. 6 is a timing chart showing the operation of the circuit of FIG. 5.

FIG. 5 is a block diagram illustrating the construction of the PLL circuit in the display control apparatus according to a third embodiment of the present invention, and FIG. 6 is a timing chart showing the operation of the PLL circuit. It should be noted that components identical with those of the foregoing drawings are designated by like reference characters and need not be described again.

The horizontal synchronizing signal HD is a reference input signal and the signal fv is a signal obtained by frequency-dividing the output $f_{OUT}$ of the voltage-controlled oscillator 23 by means of the frequency divider 24. The signal fv basically is a signal having a frequency the same as that of the reference input signal (horizontal synchronizing signal HD). The hold switch 20 delivers the output signal of the phase comparator 21 to the low-pass filter 22 or interrupts the delivery of this signal. The output signal from the phase comparator 21 is delivered to the low-pass filter 22 when the control signal (vertical synchronizing signal VD) is logical "1" and is cut off from the low-pass filter 22 when the control signal VD is logical "0". This is the same as in the foregoing embodiments.

The frequency-dividing value (T1) in a register (REG1) 50 is loaded in the frequency divider 24 via signal line 52 when the signal level of the control signal (vertical synchronizing signal VD) is in the logical "1" interval. The loading timing is the interval in which the signal fv is logical "0". When the control signal (vertical synchronizing signal VD) is logical "0", the second frequency-dividing value T2 stored in a register (REG2) 51 is loaded in the register 50 via signal line 53. The loading timing is controlled by a latch signal (LAT) 44 outputted by the controller 17.

Thereafter, the frequency-dividing value (T2) is loaded in the frequency divider 24 via the signal line 52 and, at the same time, the frequency-dividing value T1 is written in the register 51 from the controller 17 via a data line (DATA) 45. The frequency-dividing value T1 in register 51 is shifted to the register 50 by the latch signal (LAT) 44 from the controller 17 when the control signal (vertical synchronizing signal VD) changes from logical "0" to logical "1". Thus, the next frequency-dividing value is always set in the register 51 in advance and the frequency-dividing value is controlled in dependence upon the signal level of the control signal (vertical synchronizing signal VD), thereby making it possible to operate the PLL circuit stably.

In the timing chart of FIG. 6 showing the operation of the circuit of FIG. 5, it is assumed that the phase of the input reference signal (horizontal synchronizing signal HD) and the phase of the signal fv whose phase is compared with that of the reference signal are in agreement (the locked state). When the signal fv is logical "0" in an interval in which the level of the control signal (vertical synchronizing signal VD) is logical "1", the frequency-dividing value T1 is set in the frequency divider 24 from the register 50. Further, the frequency-dividing value T2 to be set in the interval in which the control signal (vertical synchronizing signal VD) is logical "0" is set in the register 51 in advance.

The controller 17 monitors the signal level of the control signal (vertical synchronizing signal VD) at all times. When the level of the VD signal changes from logical "1" to logical "0", the controller 17 outputs the latch signal 44. As a result, the frequency-dividing value T2 in register 51 is loaded in the register 50 via the signal line 53. At the same time, the controller 17 sets the frequency-dividing value T1 in the register 51 through the data line 45.

The frequency-dividing value T1 is a frequency-dividing value (T1) for operating the PLL circuit 41 in the interval in which the signal level of the control signal (vertical synchronizing signal VD) is logical "1", just as in the embodiments described above. Thus, the PLL circuit 41 is operated at period t2 in the interval in which the signal level of the control signal (vertical synchronizing signal VD) is logical "0" and at the period t1 when the signal level of the control signal (vertical synchronizing signal VD) is logical "1".

Figure 7:
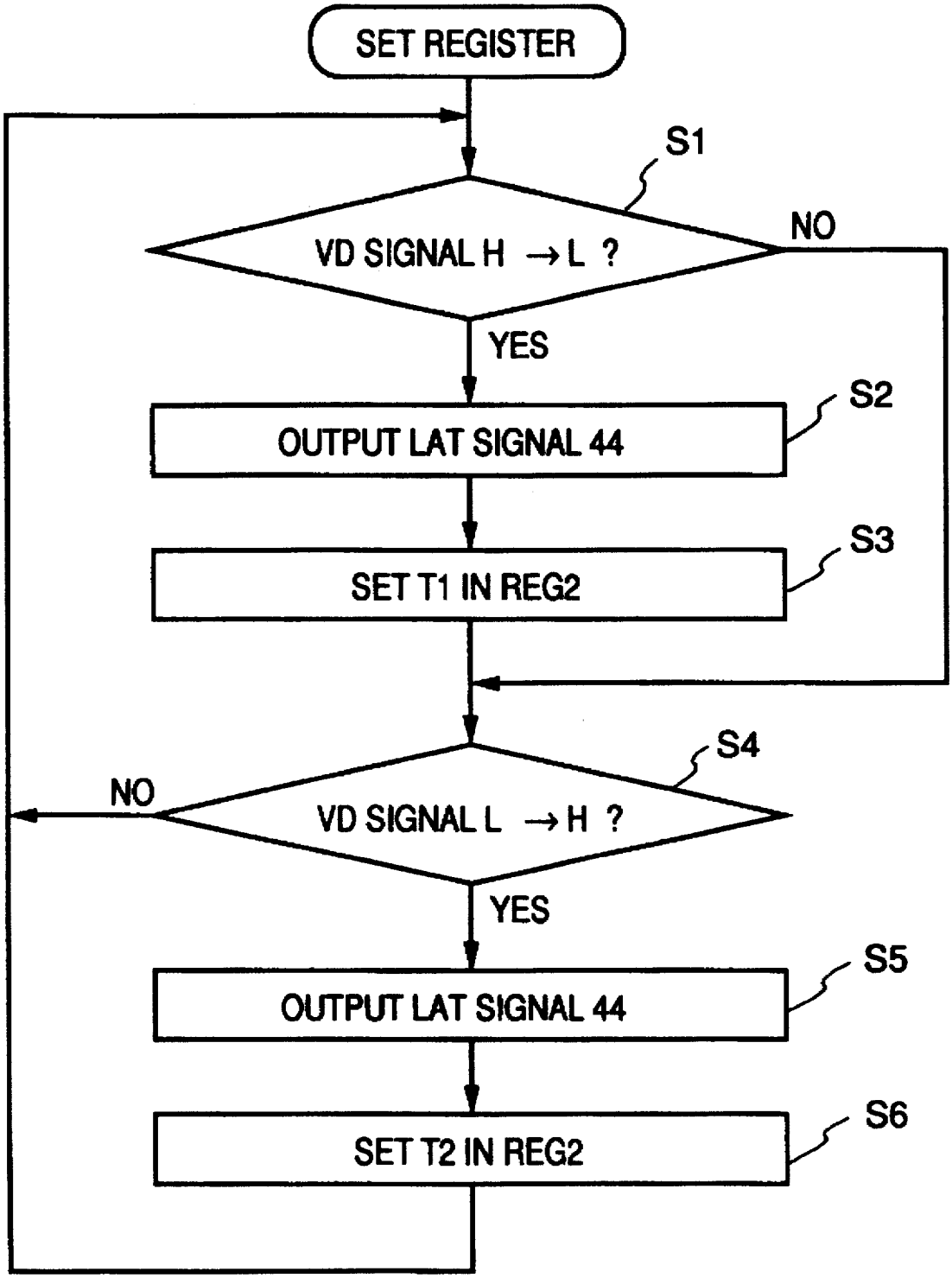
FIG. 7 is a flowchart illustrating processing for setting a register of a controller according to the third embodiment.

FIG. 7 is a flowchart showing the operation for setting data in the registers 50 and 51 by the controller 17 of the display control apparatus 1 of this embodiment. The control program for executing this processing is stored in the ROM 171.

First, at step S1, it is determined whether the vertical synchronizing signal (VD) has changed from logical "1" (the high level) to logical "0" (the low level). If the decision rendered is "YES", then the program proceeds to step S2, at which the latch signal (LAT) 44 is outputted and the frequency-dividing value (T2) stored in the register (REG2) 51 is set in the register (REG1) 50. As a result, the frequency-dividing value of the frequency divider 24 changes to T2 at the negative-going transition of the next signal fv. The program then proceeds to step S3, at which the frequency-dividing value (T2) prevailing when the display is blank is set in the register 51.

Next, at step S4, it is determined whether the vertical synchronizing signal (VD) has changed from the low level to the high level). If the decision rendered is "YES", then the program proceeds to step S5, at which the latch signal 44 is outputted and the frequency-dividing value (T1) stored in the register 51 is set in the register (REG1) 50 The program then proceeds to step S6, at which the frequency-dividing value (T1) prevailing when the display is blank is set in the register 51.

In accordance with this embodiment as described above, when a PLL circuit is operated, frequency-dividing values corresponding to respective frequencies are provided so that even if the frequency of the reference signal changes, an increase in jitter or an unlocked state, which are problems encountered in PLL circuits, can be prevented. This makes it possible to operate the system in a stable state.

The present invention can be applied to a system constituted by a plurality of devices or to an apparatus comprising a single device. Furthermore, it goes without saying that the invention is applicable also to a case where the object of the invention is attained by supplying a program to a system or apparatus.

Thus, in accordance with the present invention as described above, a display clock which is stable against a fluctuation in frequency can be generated even in cases where the reference signal is outputted at a plurality of frequencies.

As many apparently widely different embodiments of the present invention can be made without departing from the spirit and scope thereof, it is to be understood that the invention is not limited to the specific embodiments thereof except as defined in the appended claims.

What is claimed is:

1. A display control apparatus for generating a display clock signal, which corresponds to a video signal, from a reference signal, comprising:

memory means for storing at least two different frequency-dividing values;

selecting means for selecting one of the frequency-dividing values stored in said memory means in a blanking interval of the video signal, and for selecting another one of the frequency-dividing values in other intervals than the blanking interval;

frequency-dividing means for dividing a period of the display clock signal in dependence upon the frequency-dividing value selected by said selecting means, and for generating a frequency-divided signal;

comparator means for comparing the frequency-divided signal with the reference signal, and for outputting a voltage signal having a voltage level conforming to a result of comparison;

hold means for either outputting the voltage signal in other than the blanking interval, or for holding the voltage signal in other than the blanking interval and outputting the voltage signal in the blanking interval, as the result of comparison by said comparator means;

filter means, provided after said hold means, for passing a predetermined frequency component of the voltage signal from said hold means; and clock generating means for generating the display clock signal on the basis of the signal from said filter means.

2. The apparatus according to claim 1, wherein the reference signal is a horizontal synchronizing signal.

3. The apparatus according to claim 1, wherein said hold means holds the output from said comparator means when a vertical synchronizing signal of the video signal is off.

4. The apparatus according to claim 1, further comprising smoothing means for smoothing an output voltage level of the voltage signal from said comparator means.

5. The apparatus according to claim 4, wherein said clock generating means outputs a clock signal having a frequency conforming to an output voltage level from said smoothing means.

6. The apparatus according to claim 1, wherein said comparator means, said frequency dividing means and said clock generating means construct a PLL circuit.

7. A display control method for generating a display clock signal, which corresponds to a video signal, from a reference signal, comprising:

a selecting step of selecting one of a plurality of frequency-dividing values, stored in a memory, in a blanking interval of the video signal, and of selecting another one of the frequency-dividing values stored in the memory in other intervals than the blanking interval;

a frequency-dividing step of dividing a period of the display clock signal in dependence upon the selected frequency-dividing value selected in said selecting step, and generating a frequency-divided signal;

a comparison step of comparing the frequency-divided signal with the reference signal and outputting a voltage signal having a voltage level conforming to a result of comparison;

a holding step of either outputting the voltage signal in other than the blanking interval, or holding the voltage signal in other than the blanking interval and outputting the voltage signal in the blanking interval, as the result of comparison in said comparison step;

a filtering stem of massing a predetermined frequency component of the voltage signal output in said holding step; and a clock generating step of generating the display clock signal on the basis of the signal output in said filtering step.

8. The method according to claim 7, wherein the reference signal is a horizontal synchronizing signal.

9. The method according to claim 7, wherein in said holding step, an output in said comparison step is held when a vertical synchronizing signal of the video signal is off.

10. The method according to claim 7, further comprising a step of smoothing an output voltage level from said comparison step.

11. The method according to claim 10, wherein in said clock generating step, the display clock signal has a frequency conforming to an output voltage level from said smoothing step.

12. The method according to claim 7, wherein said comparison step, said frequency dividing step and said clock generating step combine to perform a PLL function.

* * * * *

UNITED STATES PATENT AND TRADEMARK OFFICE

CERTIFICATE OF CORRECTION

PATENT NO. : 5,721,570

DATED : February 24, 1998

INVENTORS : TAKASHI TSUNODA ET AL.

It is certified that error appears in the above-identified patent and that said Letters Patent is hereby corrected as shown below:

ON THE TITLE PAGE

[63] "Dec. 19, 1994" should read --Dec. 13, 1994--.

COLUMN 4

Line 9, "basis" should read --basis of--.

COLUMN 9

Line 18, "50" should read --50.--.

Signed and Sealed this

Eighteenth Day of August, 1998

Bruce Lehman

*Attest:*

BRUCE LEHMAN

*Attesting Officer*

*Commissioner of Patents and Trademarks*